US007154462B2

(12) United States Patent
Park et al.

(10) Patent No.: US 7,154,462 B2
(45) Date of Patent: Dec. 26, 2006

(54) METHOD AND APPARATUS FOR DRIVING LIQUID CRYSTAL DISPLAY

(75) Inventors: Jong Jin Park, Seoul (KR); Hyun Ho Shin, Kunpo-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 1236 days.

(21) Appl. No.: 09/725,849

(22) Filed: Nov. 30, 2000

(65) Prior Publication Data

US 2001/0004252 A1 Jun. 21, 2001

(30) Foreign Application Priority Data

Nov. 30, 1999 (KR) ..... 1999-53729

(51) Int. Cl.
*G09G 3/36* (2006.01)

(52) U.S. Cl. ..... 345/94; 345/92; 345/96; 345/100; 345/209

(58) Field of Classification Search ..... 345/87–103
See application file for complete search history.

(56) References Cited

U.S. PATENT DOCUMENTS 4,778,260 A * 10/1988 Okada et al. ..... 345/97
5,907,313 A * 5/1999 Kubota et al. ..... 345/100
6,297,792 B1 * 10/2001 Takahashi ..... 345/91
6,307,681 B1 * 10/2001 Aoki et al. ..... 359/645
6,342,881 B1 * 1/2002 Inoue ..... 345/204
6,396,469 B1 * 5/2002 Miwa et al. ..... 345/87

* cited by examiner

*Primary Examiner*—Lun-Yi Lao
(74) *Attorney, Agent, or Firm*—Birch, Stewart, Kolasch & Birch, LLP

(57) ABSTRACT

Driving a liquid crystal display device to eliminate a residual image upon realization of a moving picture. A first signal is applied to liquid crystal pixel cells for charging thereof during a beginning of a frame. A second signal is applied to the liquid crystal pixel cells for discharging thereof during an ending of the frame. Accordingly, a residual image on a screen can be eliminated.

16 Claims, 13 Drawing Sheets

CONVENTION ART

CONVENTION ART

| | | | | | | | | |
|---|---|---|---|---|---|---|---|---|
| Vpolarity1 | + | | − | | + | | − | |
| | | | | | | | | |
| Vpolarity2 | + | 0 | − | 0 | + | 0 | − | 0 |

METHOD AND APPARATUS FOR DRIVING LIQUID CRYSTAL DISPLAY

BACKGROUND OF THE INVENTION

1. Field of the Invention

This invention relates to a technique of driving a liquid crystal display, and more particularly to a method and apparatus for driving a liquid crystal display that is adaptive for eliminating a residual image generated upon the realization of a moving picture.

2. Description of the Related Art

Generally, a liquid crystal display (LCD) of an active matrix driving system uses thin film transistors (TFTs) as switching devices and allows signals to be applied to each of the picture elements in the thin TFTs to thereby display a picture. For a given display screen size, an LCD device requires less space and consumes less power than a cathode ray tube (CRT) device. Accordingly, LCDs have been widely used as monitors for personal computers, notebook computers as well as office automation equipment such as copy machines, and a portable equipment such as cellular phones and pagers.

The active matrix LCD displays a picture corresponding to video signals, such as television signals, on a pixel (or picture element) matrix having liquid crystal pixel cells arranged between intersections between gate lines and data lines. The TFTs are arranged adjecently to each intersection between the gate lines and the data lines and are turned on when a scanning signal (i.e., a gate pulse) is applied from the gate line. Then, a data signal on the data line is transmitted to the liquid crystal cell.

As shown in FIG. 1, the conventional active matrix display includes a liquid crystal display panel 2 having liquid crystal pixel cells arranged in a matrix between two transparent substrates, a gate driver 6 connected to gate lines GL1 to GLm of the liquid crystal display panel 2, and a data driver 4 connected to data lines DL1 to DLn of the liquid crystal display panel 2. TFTs are arranged at intersections between the gate lines GL1 to GLm and the data lines DL1 to DLn, respectively. The gate driver 6 sequentially applies a gate pulse to the gate lines GL1 to GLm as a scanning signal to drive the TFT connected to the corresponding gate line. One period of the gate pulse GP applied to the gate lines GL1 to GLm is set to one frame interval (e.g., 16.67 ms in the case of a NTSC system). A semiconductor channel is formed between the source and the drain of a TFT by this gate pulse GP, thereby driving the TFT. At this time, the data driver 4 applies a video data signal Vdata as shown in FIG. 2 to the data lines DL1 to DLn. Thus, as shown in FIG. 3, the liquid crystal pixel cells are charged by the video data signal Vdata when the gate pulse GP is applied to the TFT, and maintains the video data signal Vdata during one frame after the gate pulse GP transitions (e.g., turns off) . When the TFT is driven again by applying the gate pulse GP in the next frame, the liquid crystal display pixel cell charges the video data signal Vdata to have a polarity contrary to that of the video data signal Vdata of the previous frame. Also, the liquid crystal display pixel cell maintains the charged video data signal Vdata during one frame after the gate pulse GP transitions (e.g., turns-off) . Thereafter, the liquid crystal pixel cells perform the above described steps repeatedly and the video data signal Vdata is charged with its polarity being inverted at each frame. The liquid crystal pixel cells have a rising transmissivity T during one frame charging of the video data signal Vdata in a normally black mode as shown in FIG. 4 to transmit light inputted from a backlight unit to a display screen.

Due to the time period when the liquid crystal pixel cells keep the video data during one frame and discharge the video data in a next frame, a residual image is left on the screen. Particularly, such a residual image causes a blurring phenomenon, a smearing phenomenon or a ghost phenomenon on the screen upon realization of a moving picture.

Recently, studies regarding a ferro-electric liquid crystal (FLC) and an anti-ferro-electric liquid crystal (AFLC) having a faster response speed than that of the conventional twisted nematic liquid crystal (TNLC) have been made. However, the LCD employing the FLC or AFLC has a problem in that, since it has a sufficiently rapid response speed of less than hundreds of microseconds, it is of great advantage to the realization of moving pictures, but it fails to completely eliminate a residual images when the LCD is driven by the conventional driving method.

SUMMARY OF THE INVENTION

Accordingly, the present invention provides a method and apparatus of driving a liquid crystal display that displays moving pictures without residual images.

A method of driving a liquid crystal display according to one aspect of the present invention includes the steps of applying ON data signal to liquid crystal pixel cells to display data during the beginning of a frame; and applying an OFF data signal (e.g., data having a ground voltage) turning off the liquid crystal pixel cells to display data during the end of the same frame.

A driving apparatus for a liquid crystal display according to another aspect of the present invention includes a data driver for applying an ON data signal to liquid crystal pixel cells to display data at the beginning of a frame and for applying an OFF data signal turning off the liquid crystal pixel cells at the end region of the same frame, and a gate driver for applying a gate pulse to the gate lines twice during a single frame interval to sequentially apply the ON data signal and the OFF data signal to the liquid crystal pixel cells during a single frame.

BRIEF DESCRIPTION OF THE DRAWINGS

These and other features of the invention will be apparent from the following detailed description of the embodiments of the present invention with reference to the accompanying drawings, in which.

DETAILED DESCRIPTION OF THE PREFERRED EMBODIMENT

Figure 1:
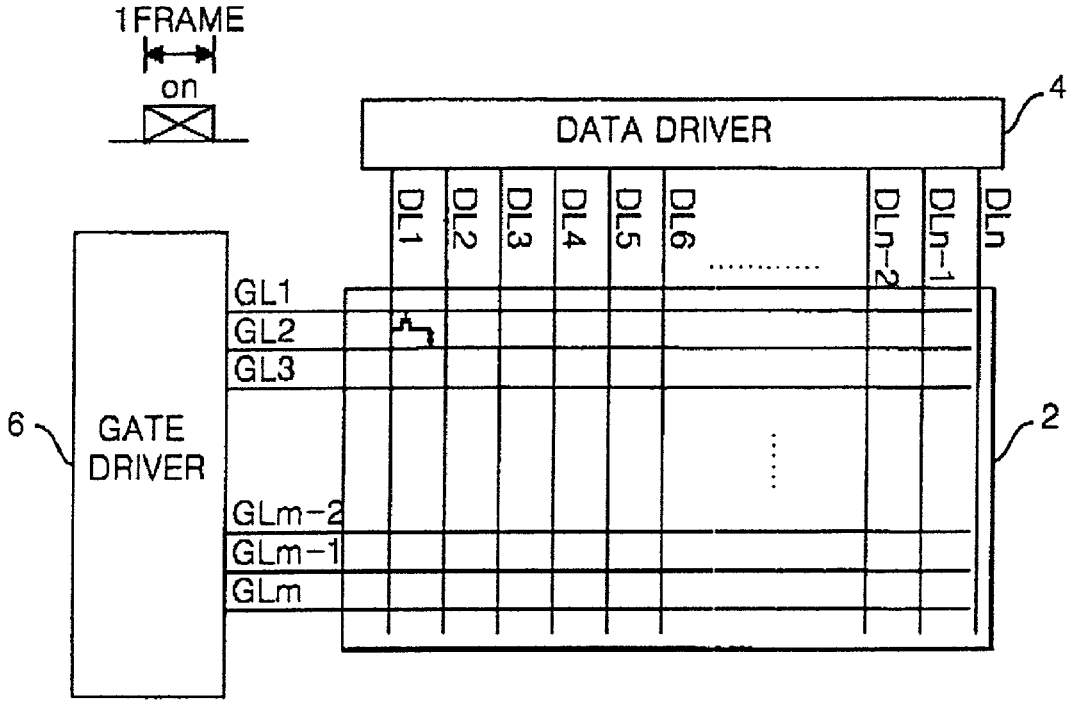
FIG.1 CONVENTIONAL ART
FIG. 1 is a schematic block diagram showing a configuration of a conventional liquid crystal display device.
Figure 2:
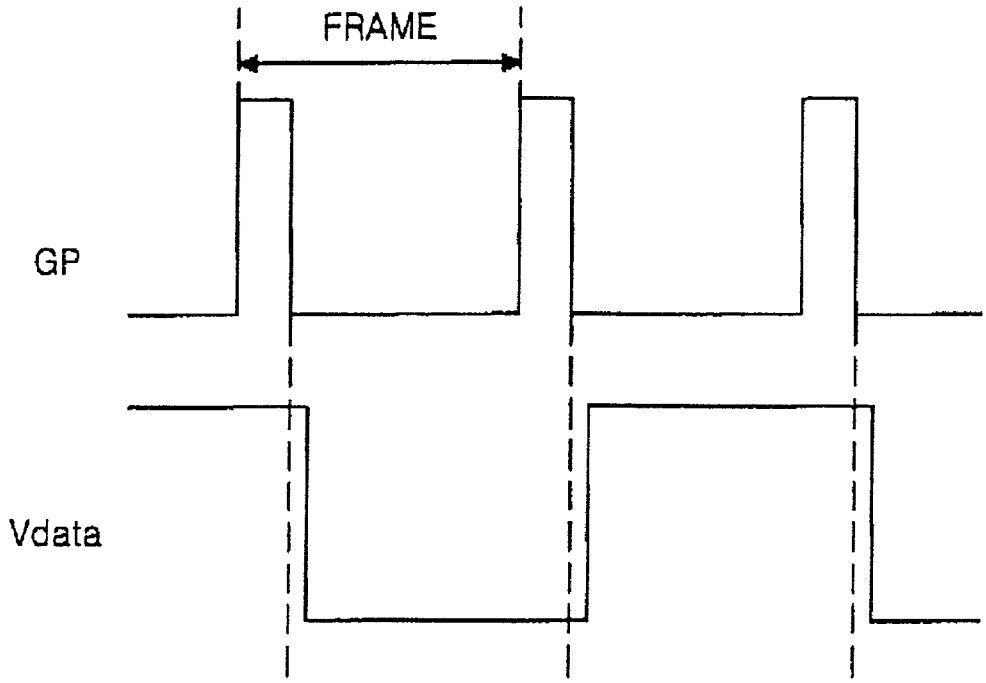
FIG. 2 shows conventional waveform diagrams of a gate pulse and a data signal applied to the liquid crystal display device shown in FIG. 1.
Figure 3:
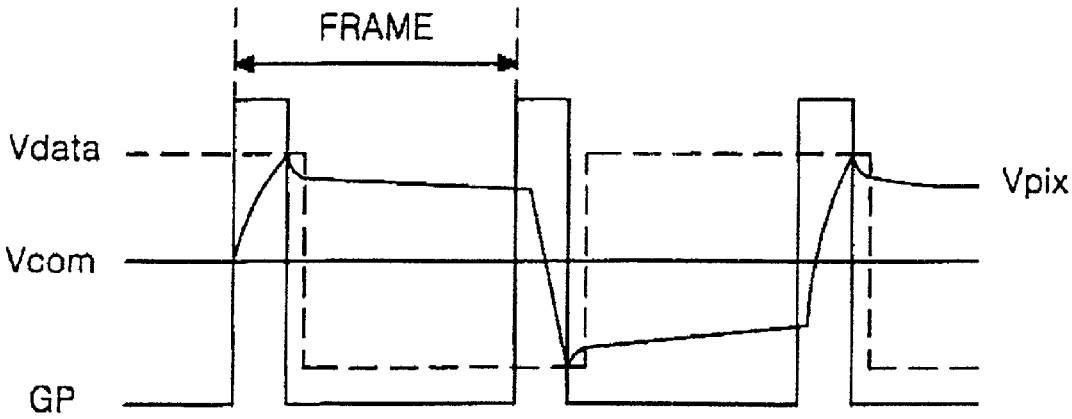
FIG. 3 is a conventional waveform diagram of a voltage charged in a liquid crystal pixel cell in accordance with the gate pulse and the data signal as shown in FIG. 2.
Figure 4:
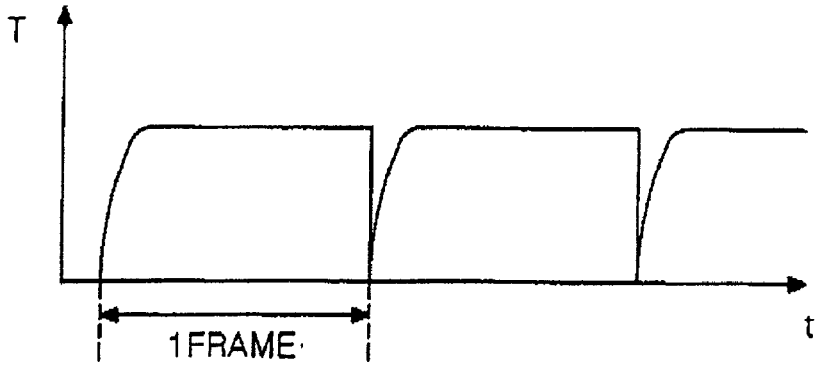
FIG.4 CONVENTIONAL ART
FIG. 4 is a conventional graph representing a transmittance characteristic that changes depending on the voltage charged in the liquid crystal display cell as shown in FIG. 3.
Figure 5:
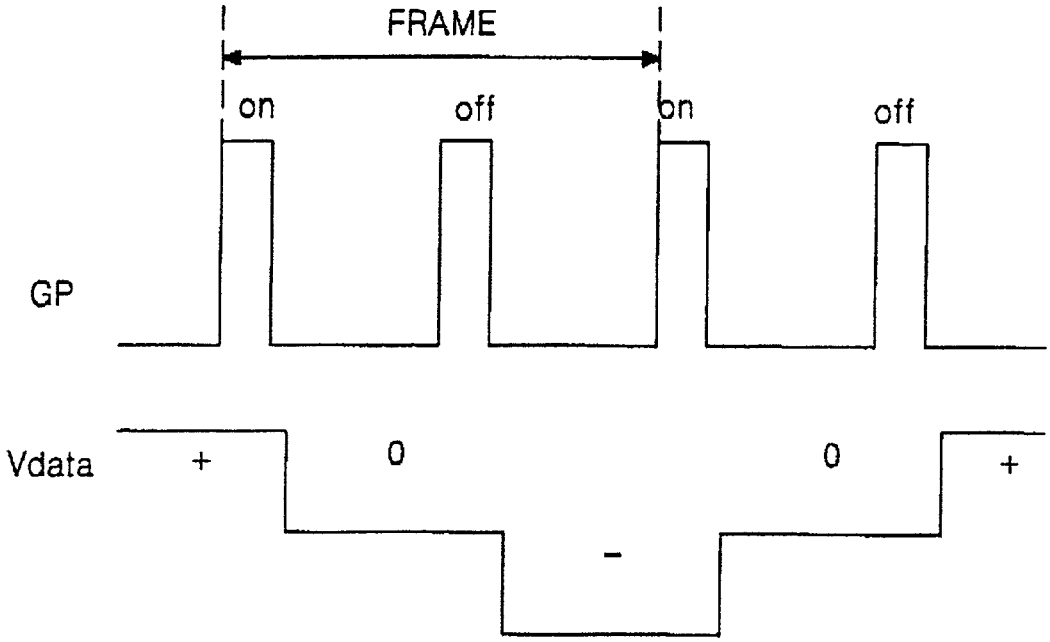
FIG. 5 shows waveform diagrams of a gate pulse and a data signal in a method of driving a liquid crystal display device according to an embodiment of the present invention.

Referring to FIG. 5, in a method of driving a liquid crystal display (LCD) according to the present invention, one period of a gate pulse GP is set to for example, a half frame interval. By virtue of this gate pulse GP, each TFT is turned on twice during one frame. A video data signal Vdata synchronized with the gate pulse GP and applied to data lines DL1 to DLn is alternatively inverted in polarity and has an interval of off-voltage region between the intervals of inverted polarity.

Figures 6, 7:
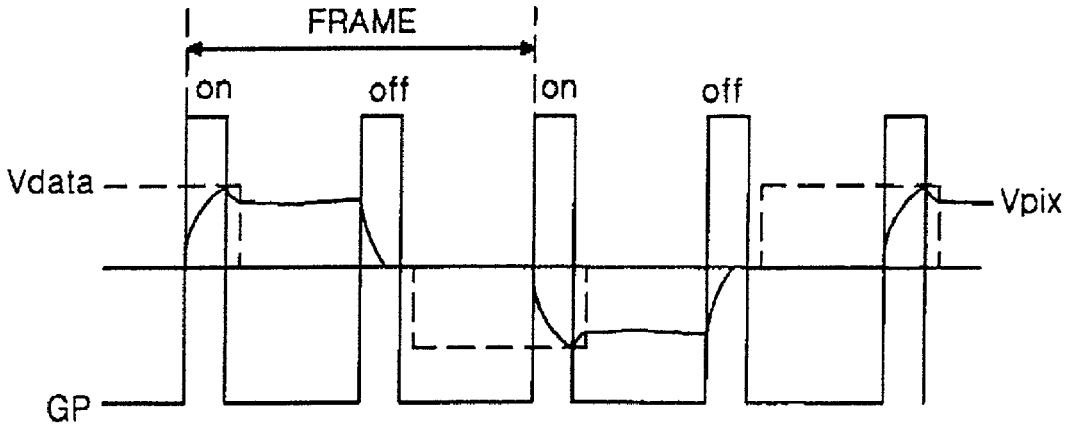
FIG. 6 is a view for comparing the polarity of a data signal Vdata1 applied to the conventional liquid crystal display device with that of a data signal Vdata2 applied to the liquid crystal display device according to the embodiment of the present invention.
FIG. 7 is a waveform diagram of a voltage signal Vdata charged in a liquid crystal pixel cell in accordance with the gate pulse and the data signal as shown in FIG. 5.

FIG. 6 compares the polarity of a video data signal Vpolarity1 applied to the conventional LCD device with that of a video data signal Vpolarity2 applied to the LCD device according to the present invention. As seen from FIG. 6, in the conventional art, the polarity of the video data signal Vpolarity1 is inverted for every frame. On the other hand, the video data signal Vpolarity2 applied to the present LCD device has a positive(+) voltage level or negative(−) voltage level in the first half interval of each frame and maintains a ground voltage GND in the remaining half interval. The video data signal Vpolarity2 having a positive(+) or negative (−) voltage level that is applied in the first half interval of each frame has an inverted polarity every frame. Also, the video data signal has a positive polarity (+) when it is higher than a common voltage Vcom in the voltage level. Meanwhile, when the videl data signal is lower than the common voltage Vcom in the voltage level, it has a negative polarity (−).

As shown in FIG. 7, the liquid crystal pixel cells are charged by a video data signal when the gate pulse GP is applied to the TFT and a channel of the TFT is formed. After the gate pulse is turned off, the liquid crystal pixel cells maintain the charged video data signal. When the gate pulse GP is again applied to the TFTs during the duration of the frame, e.g., at the mid-point of the frame, the TFTs are driven and the liquid crystal pixel cells perform a discharge due to an off-voltage applied on the data lines. After the gate pulse GP is again turned off, the liquid crystal pixel cells maintain a ground voltage.

Figure 8:
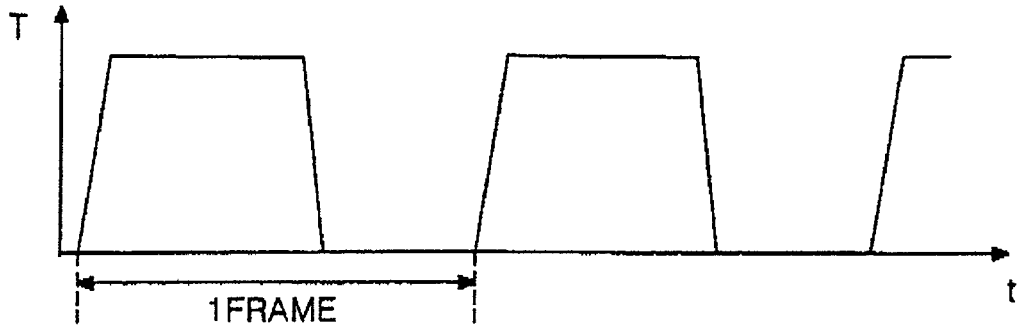
FIG. 8 is a graph representing a transmittance characteristic that changes depending on the voltage charged in the liquid crystal display cell as shown in FIG. 7.

Thus, the liquid crystal pixel cells have an increasing transmittance T during the beginning half interval of each frame charged by the video data Vdata as shown in FIG. 8 in a normally black mode to transmit a light inputted from a backlight unit, and have a decreasing transmittance T during the ending half interval of each frame to shut off the incident light. As a result, since each of the liquid crystal pixel cells is completely discharged before the end of each frame, a residual image does not appear in the next frame by the video data maintained in the previous frame. In other words, the liquid crystal pixel cells are turned on and off in approximately a half period of each frame.

Figure 9:
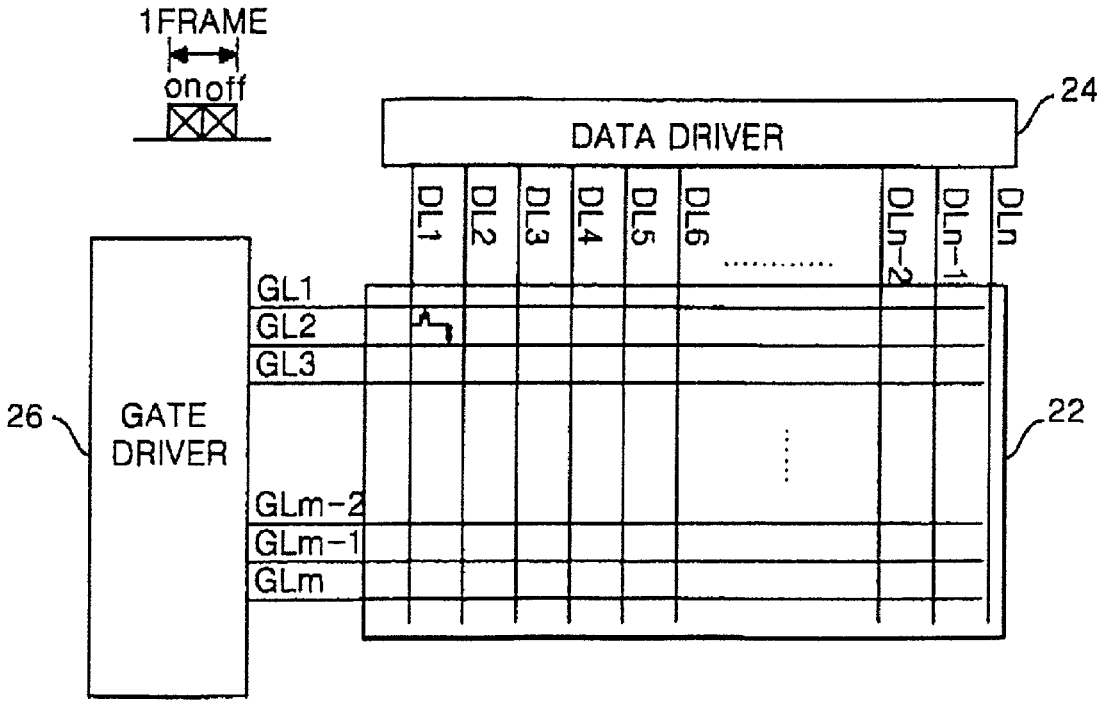
FIG. 9 is a schematic block diagram showing a configuration of a driving apparatus for a liquid crystal display according to an embodiment of the present invention.

FIG. 9 shows a driving apparatus for a LCD according to an embodiment of the present invention that turns on and off liquid crystal pixel cells during approximately a half period of each frame as shown FIG. 5. Referring to FIG. 9, the present LCD driving apparatus includes a liquid crystal display panel 22 having liquid crystal pixel cells arranged between two sheets of transparent substrates in a matrix type, a gate driver 26 for applying a gate pulse GP to gate lines GL1 to GLm of the liquid crystal display panel 22 twice every frame, and a data driver 24 synchronized with the gate pulse GP to apply a video data Vdata including an ON data and an OFF data to data lines DL1 to DLn of the liquid crystal display panel 22. TFTs are arranged at intersections between the m gate lines GL1 to GLm and the n data lines DL1 to DLn, respectively.

Figure 10:
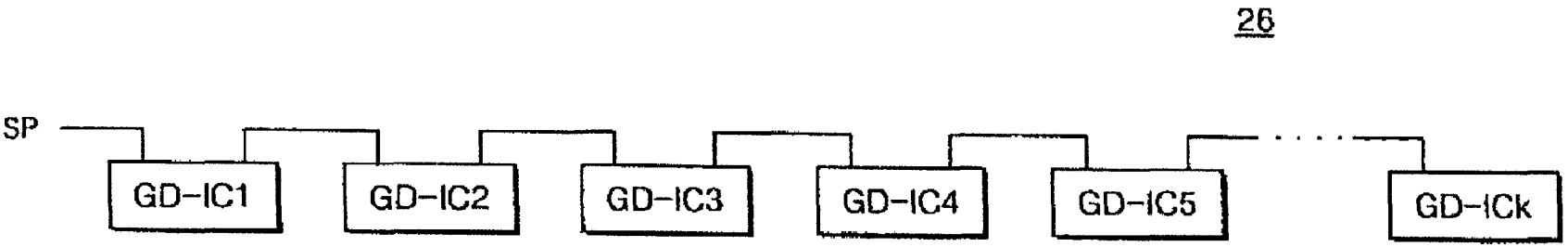
FIG. 10 is a detailed block diagram of the gate driver in FIG. 9.
Figure 11:
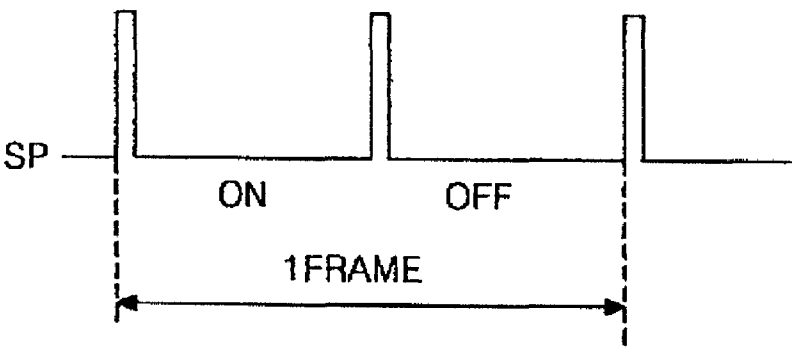
FIG. 11 is a waveform diagram of the start pulse shown in FIG. 9.

As shown in FIG. 10, the gate driver 26 includes k gate drive integrated circuits GD-IC1 to GD-ICk each having a plurality of shift registers and connected in cascade. As shown in FIG. 11, the gate drive integrated circuits GD-IC1 to GD-ICk respond to a start pulse SP generated during each frame, e.g., every half period of each frame, to sequentially generate the gate pulse GP. The start pulse SP is generated at the beginning of each frame. The ON data of the video data signal Vdata is synchronized with the start pulse SP to be applied to the data lines DL1 to DLn. The first to Kth gate drive integrated circuits GD-IC1 to GD-ICk respond to the start pulse SP to sequentially generate the gate pulse GP. Thus, the start pulse SP is generated again in the middle of each frame. The OFF data of the video data signal Vdata is synchronized with the start pulse SP to be applied to the data lines DL1 to DLn. The first to Kth gate drive integrated circuits GD-IC1 to GD-ICk respond to the start pulse SP to sequentially generate the gate pulse GP. Accordingly, the liquid crystal pixel cells charge the off data at the beginning half of the frame. For instance, the liquid crystal pixel cells are charged with the on data (i.e., a data having a positive or negative voltage level) in the first half interval of the frame in a normally black mode, and are discharged by the off data (i.e., a data having a ground voltage) in the remaining half interval of the frame to maintain a ground voltage.

Figure 12:
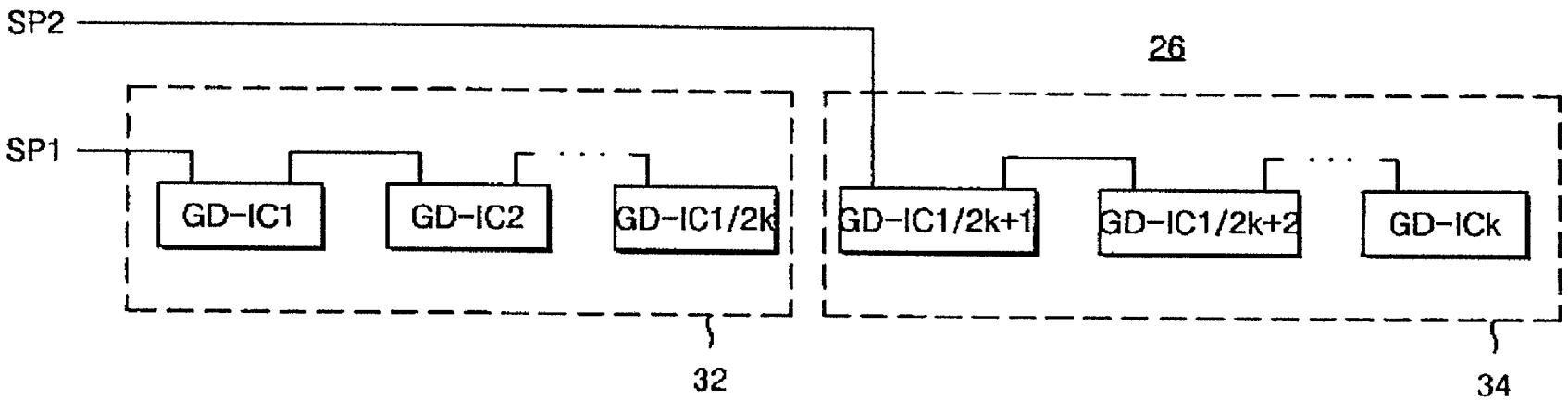
FIG. 12 is a detailed block diagram of another embodiment of the gate driver in FIG. 9.
Figure 13:
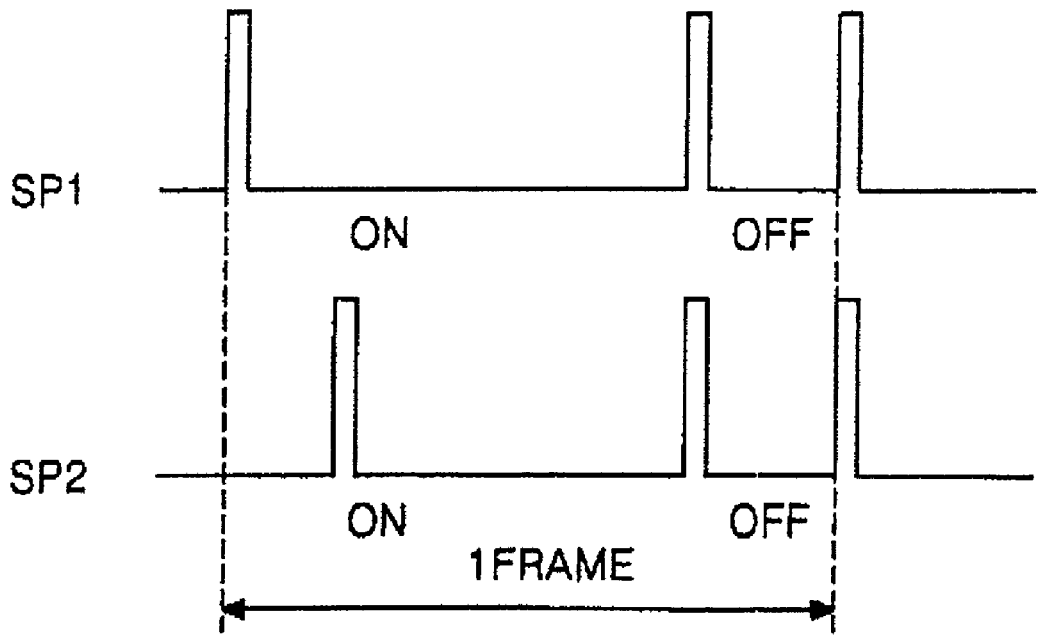
FIG. 13 is a waveform diagram of the start pulse shown in FIG. 12.
Figure 14:
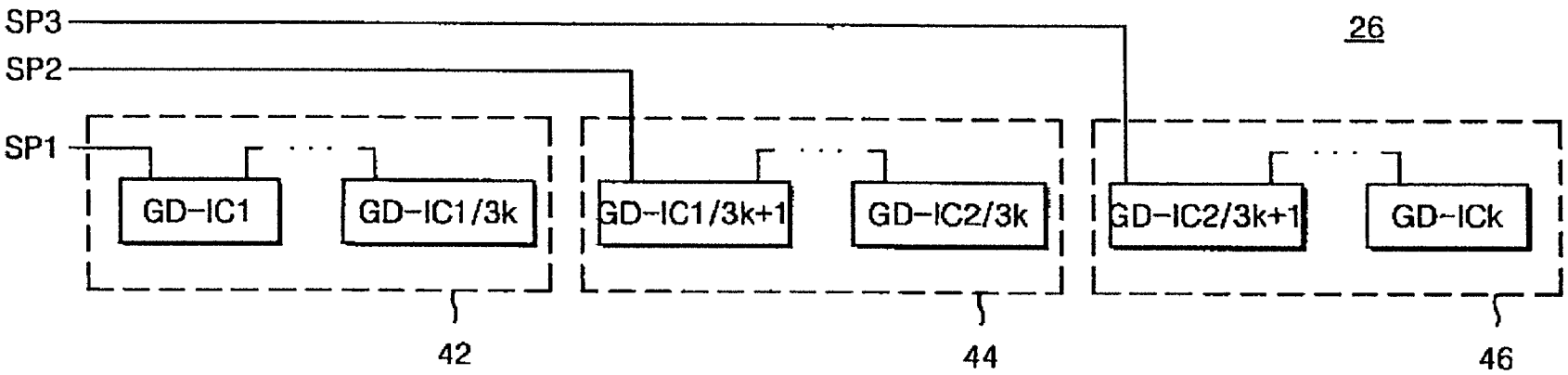
FIG. 14 is a detailed block diagram of still another embodiment of the gate driver in FIG. 9.

FIG. 12 and FIG. 14 show other embodiments of the gate driver 26. Referring first to FIG. 12, the gate driver 26 includes first and second gate drive blocks 32 and 34 for applying a gate pulse in response to first and second start pulses SP1 and SP2, respectively. The first start pulse SP1 drives gate drive integrated circuits GD-IC1 to GD-IC1/2k included in the first gate drive block 32, allowing the gate drive integrated circuits GD-IC1 to GD-IC1/2k to generate a gate pulse GP sequentially. The second start pulse SP2 drives gate drive integrated circuits GD-IC1/2k+1 to GD-ICk included in the second gate drive block 34, allowing the gate drive integrated circuits GD-IC1/2k+1 to GD-ICk to generate a gate pulse GP sequentially. The first and second start pulses SP1 and SP2 are generated twice within one frame interval as shown in FIG. 13. First pulses generated from the first and second start pulses SP1 have a desired phase difference, the first one of the second pulses being generated a predetermined time after the first one of the first pulses. First, the first start pulse SP1 is generated at the beginning of the frame. The ON data of the video data signal Vdata is applied in synchronization with the first start pulse SP1, and the gate drive integrated circuits GD-IC1 to GD-IC1/2k sequentially produce a gate pulse in response to the first start pulse SP1. Thus, the liquid crystal pixel cells on a field block including gate lines connected to the first gate drive block 32 charge the ON data simultaneously at the beginning of the frame. Subsequently, the second start pulse SP2 is generated. At this time, the ON data corresponding to a field block including gate lines connected to the second gate drive block 34 is applied to the data lines DL1 to DLn. By virtue of the second start pulse SP2, the liquid crystal pixel cells on a field block including gate lines connected to the second gate drive block 34 charge the ON data. After the liquid crystal pixel cells at all the lines are charged with the ON data, the first and second start pulse SP1 and SP2 are generated simultaneously. At this time, the video data signal Vdata changes into the OFF data to be applied to the liquid crystal pixel cells.

Figure 15:
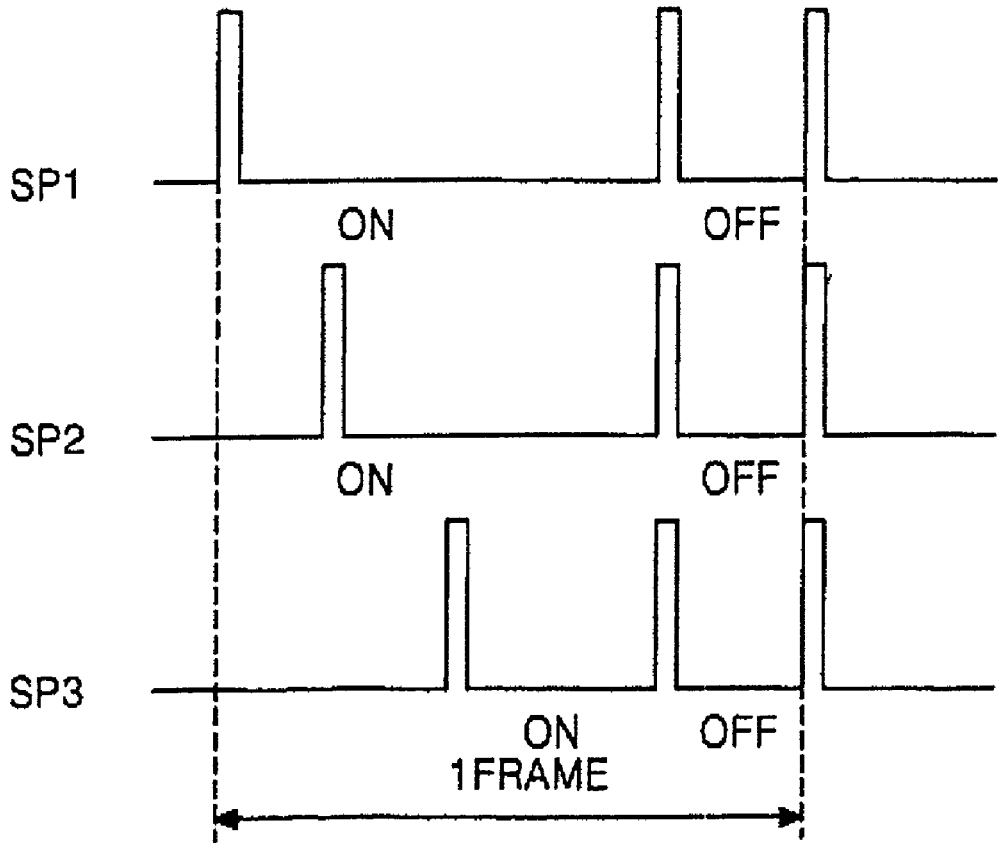
FIG. 15 is a waveform diagram of the start pulse shown in FIG. 14.

Referring now to FIG. 14, there is shown a gate driver in which gate drive integrated circuits GD-IC1 to GD-ICk are divided into first to third gate drive blocks 42, 44 and 46 driven with first to third start pulses SP1, SP2 and SP3 different from each other, respectively. The first to third start pulses SP1, SP2 and SP3 are as shown in FIG. 15. The respective start pulses SP1, SP2 and SP3 are sequentially applied to the first to third gate drive blocks 42, 44 and 46 at the beginning of the frame. At this time, the liquid crystal pixel cells charge the ON data of the video data signal Vdata. After the liquid crystal pixel cells included in all the lines on the field are charged with the ON data in this manner, the first to third start pulses SP1, SP2 and SP3 are simultaneously applied to the OFF data of the video data Vdata.

Figure 16:
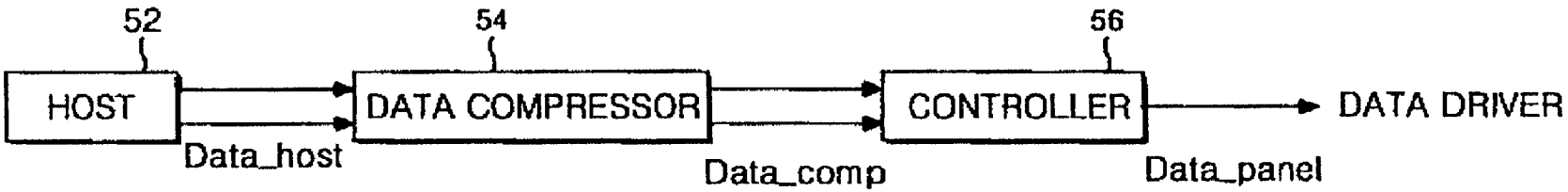
FIG. 16 is a block diagram showing an arrangement of a data compressor for compressing a data supplied to the data driver in FIG. 9 and a controller.
Figure 17:
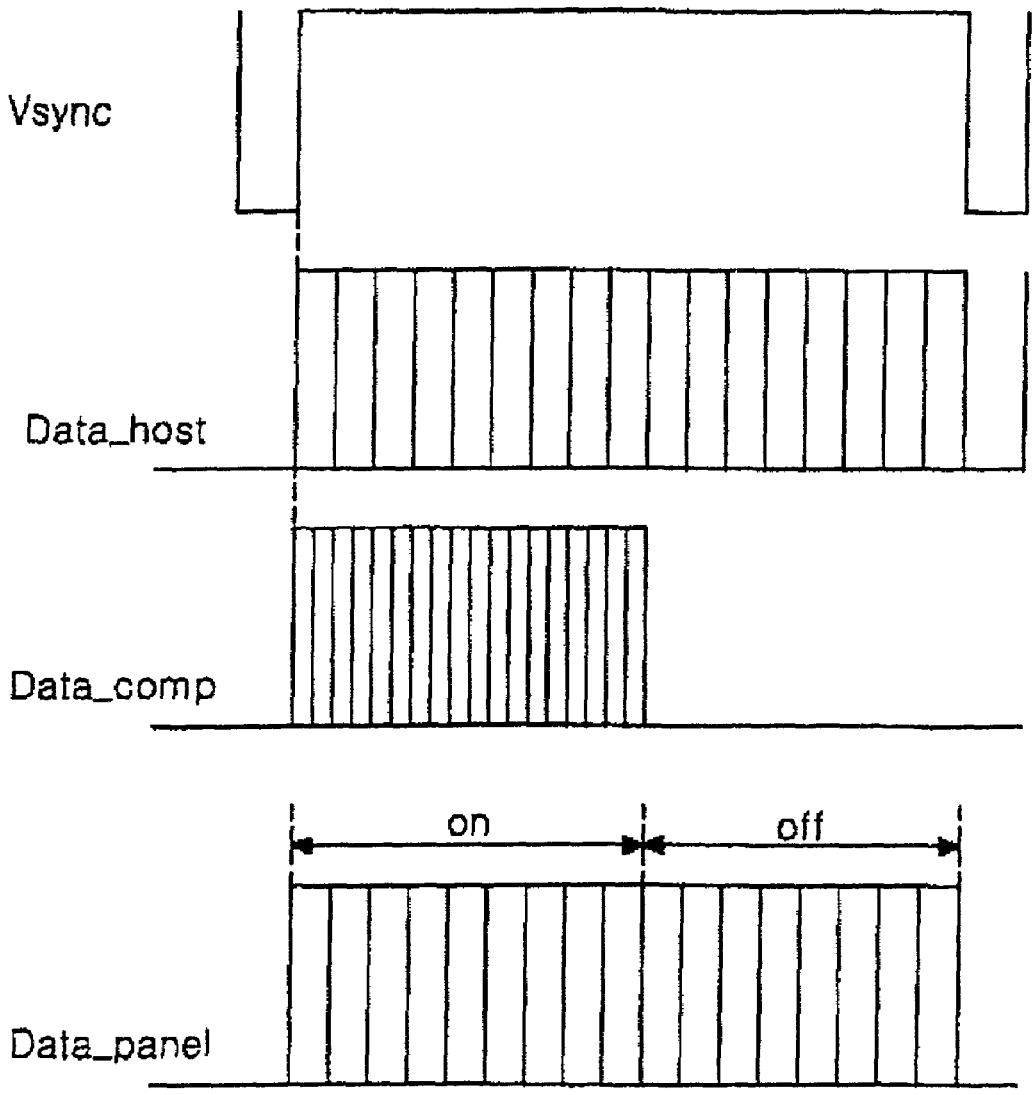
FIG. 17 shows input and output waveform diagrams of the data compressor and the controller shown in FIG. 16.

The video data including an ON data region and an OFF data region in one frame are applied to a data driver 24. As shown in FIG. 16 and FIG. 17, a video data Data_host signal applied from a graphic card of a host 52 is compressed and thereafter written into a region corresponding to the second half of a frame as the OFF data. In FIG. 16, a data compressor 54 compresses the ON data and is synchronized with a vertical synchronizing signal Vsync from the graphic card of the host 52, and then a controller 56 writes the OFF data into a region with no video data in the compressed video data Data_comp signal, that is, into the second half region of the vertical synchronizing signal Vsync. The video data Data_panel signal in which the ON data is compressed and the OFF data is written is applied to the data driver 24.

Figure 18:
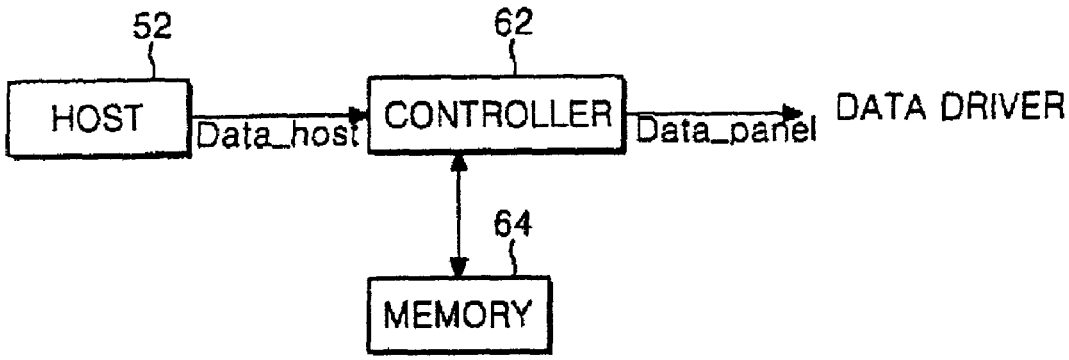
FIG. 18 is a block diagram showing another arrangement of the data compressor and the controller.

The video data Data_host signal applied from the graphic card of the host 52 can be compressed by variably controlling an input and output speed of a memory 64 as shown in FIG. 18. Referring to FIG. 18, the controller 62 stores the video data Data_host signal applied from the host 52 in the memory 64 during one period of the vertical synchronizing signal Vsync and transmits the stored video data Data_host signal to the data driver 26 at a fast frequency. If the memory 64 has a faster input speed than an output speed as mentioned above, then the video data Data_host signal applied from the host 52 is compressed by a speed difference between the input and the output, to thus be applied to the data driver 24. Also, in the case of increasing the bit number of the output video data in comparison to that of the video data stored in the memory 64, the video data applied to the data driver 24 is compressed. The OFF data is written into a rear region, with no data in a video data compressed with a front region of the vertical synchronizing signal Vsync, by the controller 62. In this case, the video data region can be assigned into ½, ⅓ and ¼ . . . of the OFF data region.

Figure 19:
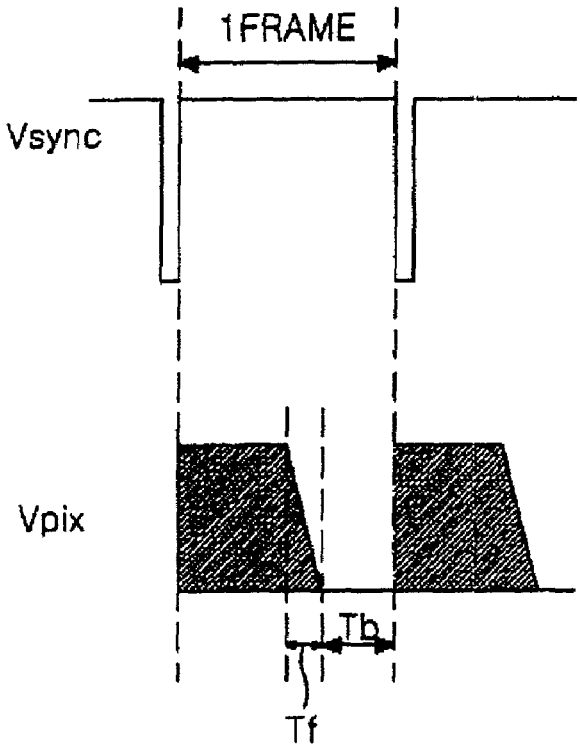
FIG. 19 shows waveform diagrams representing a falling time and a blacktime of a voltage charged in a liquid crystal pixel cell.

In the present invention as described above, the ON data is applied to the liquid crystal pixel cells at the front region of one frame and the OFF data is written at the rear region of the frame, thereby completely discharging a voltage Vpix charged in the liquid crystal pixel cells prior to the end of the frame as shown in FIG. 19. As a result, a video data is displayed on the field at the front region of the frame, and no video data is displayed at the rear region of the frame. As can be seen from FIG. 19, an ideal condition is that a black time Tb is longer than a falling time Tf. A driving method having the black time Tb longer than the falling time Tf can elimiate a redual image. Wherein, the black time is a time (or period) which the liquid crystal display cell is completely discharged, in the case of that both of the charging and the discharging is included in one frame as the present invention. The falling time is a transition time (or period) from a state, which liquid crystal pixel cell is charged, up to another state which the liquid crystal pixel cell is completely discharged.

As described above, according to the present invention, data is displayed at the front region of the frame and OFF data turning off the liquid crystal pixel cells is displayed at the rear region of the frame, thereby eliminating a residual image on the screen. The driving method and apparatus for a liquid crystal display according to the present invention can be applied to a liquid crystal display device having the conventional TNLC to prevent a residual image. Also, the present invention can be applied to a liquid crystal display device having a high-speed liquid crystal such as a high-speed TNLC, FLC or AFLC, etc. with a response speed of less than 10 ms to display a natural moving picture without any residual images.

Although the present invention has been explained by the embodiments shown in the drawings described above, it should be understood by one having ordinary skill in the art that the invention is not limited to the embodiments, but rather that various changes or modifications thereof are possible without departing from the spirit of the invention. Accordingly, the scope of the invention can be determined by the appended claims and their equivalents.

What is claimed is:

1. A method of driving a liquid crystal display having liquid crystal pixel cells arranged at each intersection between a plurality of gate lines and a plurality of data lines in a matrix type and being driven with thin film transistors, said method comprising:

applying a first signal to the liquid crystal pixel cells through said data lines for charging thereof during a beginning of a frame; and applying a second signal different from said first signal to the liquid crystal pixel cells through said data lines for discharging thereof during an ending of the frame.

2. The method according to claim 1, wherein each of the liquid crystal pixel cells includes a liquid crystal layer formed of any one of a ferro-electric liquid crystal and an anti-ferro-electric liquid crystal.

3. The method according to claim 1, wherein each of the liquid crystal pixel cells includes a liquid crystal layer formed of a twisted nematic liquid crystal having a response speed of less than 10 ms.

4. The method according to claim 1, further comprising the step of:

applying a gate pulse to the gate lines twice during the frame to sequentially apply the first signal and the second signal to the liquid crystal pixel cells.

5. A driving apparatus for a liquid crystal display having liquid crystal pixel cells arranged in a matrix at each intersection between a plurality of gate lines and a plurality of data lines and being driven with thin film transistors, said apparatus comprising:

a data driver to apply a first signal to the liquid crystal pixel cells for charging thereof during a beginning of a frame and to apply a second signal different from said first signal to the liquid crystal pixel cells for discharging thereof during an ending of the frame; and a gate driver to apply a gate pulse signal with at least two gate pulses to the gate lines during the frame to sequentially apply the first signal and the second signal to the liquid crystal pixel cells.

6. The driving apparatus according to claim 5, wherein each of the liquid crystal pixel cells includes a liquid crystal layer formed of any one of a ferro-electric liquid crystal and an anti-ferroelectric liquid crystal.

7. The driving apparatus according to claim 5, wherein each of the liquid crystal pixel cells includes a liquid crystal layer formed of a twisted nematic liquid crystal having a response speed of less than 10 ms.

8. The driving apparatus according to claim 5, wherein the gate driver generates a gate pulse at a start of the frame and a midpoint of the frame.

9. A driving apparatus for a liquid crystal display having liquid crystal pixel cells arranged in a matrix at each intersection between a plurality of gate lines and a plurality of data lines and being driven with thin film transistors, said apparatus comprising:

a data driver to apply a first signal to the liquid crystal pixel cells for charging thereof during a beginning of a frame and to apply a second signal to the liquid crystal pixel cells for discharging thereof during an ending of the frame;

a gate driver to apply a gate pulse signal with at least two gate pulses to the gate lines during the frame to sequentially apply the first signal and the second signal to the liquid crystal pixel cells;

a data compressor to compress the first signal synchronized with the frame front region of the frame; and a data controller to write the second signal during the ending of the frame to apply the second signal to the data driver.

10. The driving apparatus according to claim 9, further comprising:

a memory to input and output the first signal at a different speed under a control of the data controller to compress the first signal.

11. A method of operating a liquid crystal cell comprising:

charging a liquid crystal cell during a beginning portion of a frame; and completely discharging the liquid crystal cell before an end of the frame.

12. The method according to claim 11, wherein a period from charging of the liquid crystal cell to completely discharging of the liquid crystal cell is shorter than a period that completely discharging of the liquid crystal cell is maintained.

13. A method of charging a liquid crystal cell comprising:

applying any one of a positive and negative charges to a pixel electrode through data lines of the liquid crystal cell during a beginning of a frame;

applying no charge to the pixel electrode of the liquid crystal cell during an ending of the frame; and applying an opposite charge compared with a beginning of previous frame to the pixel electrode of the liquid crystal cell through said data lines during a beginning of the next frame.

14. A method of driving a liquid crystal display (LCD) device comprising at least one thin film transistor (TFT), the method comprising:

activating the TFT of a pixel element at least twice during a one frame interval;

applying a gate pulse signal to the TFT connected to a pixel element, the gate pulse signal having at least two gate pulses within a one frame interval;

applying a video data signal to the pixel element in accordance with the gate pulse signal to charge the pixel element;

wherein the step of applying the video data signal comprises:

applying any one of the positive and negative charges to the pixel element during a beginning of a frame;

applying no charge to the pixel element during an ending of the frame; and applying an opposite charge compared with a beginning of previous frame to the pixel element during a beginning of the next frame.

15. The method of claim 14, wherein at least one of the gate pulses is applied at a midpoint of the frame interval.

16. An apparatus for driving a liquid crystal display device comprising at least one thin film transistor (TPT), comprising:

a gate driver, including a plurality of gate drive circuits connected in series, to apply a gate pulse signal to the TFT connected to a pixel element, the gate pulse signal having at least two gate pulses within a one frame interval; and a data driver to apply a video data signal to the pixel element in accordance with the gate pulse signal to charge the pixel element.

* * * * *